US006832057B2

(12) United States Patent
Oguma et al.

(10) Patent No.: US 6,832,057 B2
(45) Date of Patent: Dec. 14, 2004

(54) DEVELOPING DEVICE, PROCESS CARTRIDGE, AND ELECTROPHOTOGRAPHIC IMAGE FORMING APPARATUS

(75) Inventors: Toru Oguma, Shizuoka (JP); Ken Kikuchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/394,215

(22) Filed: Mar. 24, 2003

(65) Prior Publication Data

US 2003/0180061 A1 Sep. 25, 2003

(30) Foreign Application Priority Data

Mar. 25, 2002 (JP) ..... 2002-083244

(51) Int. Cl.[7] ..... G03G 15/00; G03G 15/08
(52) U.S. Cl. ..... 399/27; 399/90
(58) Field of Search ..... 399/27, 90, 111, 399/113

(56) References Cited

U.S. PATENT DOCUMENTS

| | | | | |
|---|---|---|---|---|
| 5,768,658 | A | 6/1998 | Watanabe et al. | 399/111 |
| 5,812,909 | A | 9/1998 | Oguma et al. | 399/103 |
| 6,097,909 | A | 8/2000 | Watanabe et al. | 399/111 |
| 6,272,299 | B1 | 8/2001 | Numagami et al. | 399/111 |
| 6,377,759 | B1 | 4/2002 | Abe et al. | 399/27 |
| 6,512,895 | B2 | 1/2003 | Sakurai et al. | 399/13 |
| 6,704,525 | B2 * | 3/2004 | Oguma et al. | 399/27 |
| 2001/0017990 | A1 | 8/2001 | Oguma et al. | 399/27 |
| 2001/0038758 | A1 | 11/2001 | Oguma et al. | 399/27 |
| 2002/0012542 | A1 | 1/2002 | Karakama et al. | 399/27 |
| 2002/0021908 | A1 | 2/2002 | Matsumoto et al. | 399/27 |
| 2002/0025177 | A1 | 2/2002 | Yokoi et al. | 399/27 |
| 2002/0127024 | A1 * | 9/2002 | Matsumoto et al. | 399/27 |
| 2002/0172521 | A1 | 11/2002 | Oguma et al. | 399/27 |
| 2003/0161644 | A1 * | 8/2003 | Yokoi et al. | 399/27 |

FOREIGN PATENT DOCUMENTS

| | | |
|---|---|---|
| JP | 2000-250380 | 9/2000 |
| JP | 2001-290354 | 10/2001 |
| JP | 2001-290355 | * 10/2001 |

* cited by examiner

*Primary Examiner*—Sophia S. Chen
(74) *Attorney, Agent, or Firm*—Fitzpatrick, Cella, Harper & Scinto

(57) ABSTRACT

A developing device that is mounted to an electrophotographic image forming apparatus main body to be used for developing an electrostatic latent image formed on an electrophotographic photosensitive member, which includes a developing sleeve for developing the electrostatic latent image formed on the electrophotographic photosensitive member, a first electrode; a second electrode opposed to the first electrode, and an electrical contact portion for receiving a bias applied to the developing sleeve and the second electrode from the electrophotographic image forming apparatus main body, and in which the first electrode and the second electrode are arranged in positions to which a developer can be admitted, and a value corresponding to a capacitance between the first electrode and the second electrode which exists at the time of applying a voltage to the second electrode is detected by the electrophotographic image forming apparatus main body, thereby detecting a developer amount by the electrophotographic image forming apparatus main body.

21 Claims, 13 Drawing Sheets

DEVELOPING DEVICE, PROCESS CARTRIDGE, AND ELECTROPHOTOGRAPHIC IMAGE FORMING APPARATUS

BACKGROUND OF THE INVENTION

1. Field of the Invention

The present invention relates to a developing device, a process cartridge, and an electrophotographic image forming apparatus, which include developer-amount detecting means capable of successive detection of the residual amount of a developer.

In this specification, the term "electrophotographic image forming apparatus" refers to a structure that uses an electrophotographic image-forming system to form an image on a recording medium. Examples of the electrophotographic image forming apparatus include electrophotographic copying machines, electrophotographic printers (such as laser beam printers and LED printers), facsimile machines, and word processors.

Also, the term "process cartridge" refers to a cartridge into which at least one of charging means, developing means, and cleaning means and an electrophotographic photosensitive drum are integrally formed and which is detachably mountable to an electrophotographic image forming apparatus main body. In particular, the term "process cartridge" also refers to a cartridge into which at least the developing means and the electrophotographic photosensitive drum are integrally formed and which is detachably mountable to the electrophotographic image forming apparatus main body.

2. Related Background Art

Up to now, an electrophotographic image forming apparatus using an electrophotographic image forming process has adopted a process-cartridge system in which an electrophotographic photosensitive member and process means for acting on the electrophotographic photosensitive member are integrally formed into a cartridge, and the cartridge is detachably mountable to an electrophotographic image forming apparatus main body. The process-cartridge system enables a user per se to perform the maintenance of the apparatus without relying on a service person, thereby making it possible to improve the operability remarkably. For that reason, the process-cartridge system is widely employed in electrophotographic image forming apparatuses.

Also, in such an electrophotographic image forming apparatus of the process-cartridge system, it is necessary that the user per se exchange the cartridges. Therefore, in order to inform the user that a developer is consumed, some of the electrophotographic image forming apparatuses are equipped with developer-amount detecting means. Examples of the developer-amount detecting means include one using a system in which a change in capacitance among plural electrodes arranged within the process cartridge is detected, to thereby detect the developer amount.

Some structures of the electrodes have plural electrode plates arranged so as to be opposed to each other in positions to which a developer can be admitted.

FIG. 2 is a cross sectional view showing an example of the conventional process cartridge having the developer-amount detecting means. Developing means 52 of a process cartridge 51 is provided with a first electrode 53 and a second electrode 54 which serve to detect the developer amount.

The first electrode 53 and the second electrode 54 are arranged in a position to which toner as the developer can be admitted, and the capacitance between the electrodes is detected to thereby detect a toner amount successively.

FIG. 3 is a side view of the process cartridge 51. On a side surface of the process cartridge 51, an input contact 55 and an output contact 56 are provided. The input contact 55 is electrically connected to the first electrode 53 and serves to receive an input voltage from the image forming apparatus main body. The output contact 56 is electrically connected to the second electrode 54 and serves to send an output voltage corresponding to the toner amount to the image forming apparatus main body.

FIG. 4 shows an electrical circuit of the developer-amount detecting means.

A developer-amount detecting circuit 60 is composed of a detecting portion 64, a developing-bias circuit 61, a control circuit 62, and an amplifying circuit 63. The detecting portion 64 is composed of the first electrode 53, the second electrode 54, and a developing sleeve 57, and induces a capacitance in order to detect the toner amount. The detecting portion 64 is provided to the process cartridge 51.

On the other hand, the developing-bias circuit 61, the control circuit 62, and the amplifying circuit 63 are provided to the image forming apparatus main body.

The process cartridge 51 includes a developing-bias electrode 57*a* electrically connected to the developing sleeve 57. The image forming apparatus includes an electrical contact 65 electrically connected to the developing-bias circuit 61. When the process cartridge 51 is mounted to the image forming apparatus, the developing-bias electrode 57*a* and the electrical contact 65 that is provided to the image forming apparatus are electrically connected to each other, and a developing-bias voltage is applied to the developing sleeve 57 from the developing-bias circuit 61 of the image forming apparatus via the electrical contact 65 and the developing-bias electrode 57*a*.

Also, provided on a side surface of a frame of the process cartridge 51 are the external input contact 55 and the external output contact 56, which are to be electrically connected to the image forming apparatus. When the process cartridge 51 is mounted to the image forming apparatus main body, the external input contact 55 and the external output contact 56 contact an electrical contact 58 and an electrical contact 59 which are provided to the image forming apparatus, respectively.

The detecting portion 64 functions as an impedance element. The first electrode 53, serving as an input side electrode that is one electrode of the detecting portion 64 is connected to the developing bias circuit 61 functioning as developing-bias application means via the developing-bias electrode 57*a*.

The second electrode 54, serving as an output-side electrode that is the other electrode of the detecting portion 64, is connected to the control circuit 62. In the above structure, the first electrode 53 is connected to the developing-bias circuit 61 via the external input contact 55 and the electrical contact 58 of the apparatus main body, and the second electrode 54 is connected to the control circuit 62 via the external output contact 56 and the electrical contact 59 of the apparatus main body.

As described above, the process cartridge and a developing device, which include the developer-amount detecting means are provided with an external input contact and an external output contact. The external input contact serves to receive an input voltage to be applied to developer-amount detecting electrodes from the image forming apparatus main body. The external output contact serves to send an output voltage corresponding to the capacitance between the detecting electrodes to the image forming apparatus main body. On the other hand, the image forming apparatus main body is provided with electrical contacts which are electrically connected to the above-discussed external contacts when the process cartridge or the developing device is mounted to the image forming apparatus main body.

As described above, it is necessary to provide the process cartridge or the developing device and the image forming apparatus main body with the external input contact and the external output contact. Thus, there is a fear that the contacts have complicated structures resulting in obstacles to the downsizing of the apparatus and the reduction in costs. Further, during the progress in downsizing the apparatus, there is also a fear that the degree of freedom in the arrangement of the contacts is reduced in order to achieve the complicated structures of the contacts.

SUMMARY OF THE INVENTION

The present invention has been made in order to solve the above-mentioned problem.

An object of the present invention is to provide a developing device, a process cartridge, an electrophotographic image forming apparatus using a developing device, and an electrophotographic image forming apparatus to which a process cartridge is detachably mountable, in which a bias that is applied to a developing sleeve for developing a latent image formed on an electrophotographic photosensitive member and an electrode serving to detect the residual amount of a developer used for developing the latent image on the developing sleeve can be received from an image forming apparatus main body by common electrical contacts.

Another object of the present invention is to provide a developing device, a process cartridge, an electrophotographic image forming apparatus using a developing device, and an electrophotographic image forming apparatus to which a process cartridge is detachably mountable, in which, while maintaining a function to detect a developer residual amount, the number of electrical contacts for receiving a bias from an image forming apparatus main body can be reduced.

Another object of the present invention is to provide a developing device, a process cartridge, an electrophotographic image forming apparatus using a developing device, and an electrophotographic image forming apparatus to which a process cartridge is detachably mounted, in which the degree of freedom is improved in an arrangement of the electrical contacts for receiving a bias from an image forming apparatus main body upon arranging the electrical contacts.

Another object of the present invention is to provide a developing device, a process cartridge, an electrophotographic image forming apparatus using a developing device, and an electrophotographic image forming apparatus to which a process cartridge is detachably mountable, in which downsizing is achieved.

Another object of the present invention is to provide a developing device, a process cartridge, an electrophotographic image forming apparatus using a developing device, and an electrophotographic image forming apparatus to which a process cartridge is detachably mountable, in which a reduction in costs is achieved.

Another object of the present invention is to provide a developing device, a process cartridge, an electrophotographic image forming apparatus using a developing device, and an electrophotographic image forming apparatus to which a process cartridge is detachably mountable, in which a reliability of electrical connection is improved.

Another object of the present invention is to provide a developing device, a process cartridge, an electrophotographic image forming apparatus using a developing device, and an electrophotographic image forming apparatus to which a process cartridge is detachably mountable, in which a bias that is applied to a developing sleeve for developing a latent image formed on an electrophotographic photosensitive member and an electrode serving to detect the residual amount of a developer used for developing the latent image on the developing sleeve can be received from an image forming apparatus main body by common electrical contacts.

These and other objects, features, and advantages of the present invention will become more apparent upon consideration of the following description of the preferred embodiments of the present invention taken in conjunction with the accompanying drawings.

DESCRIPTION OF THE PREFERRED EMBODIMENTS (Embodiment 1)

(Overview of Image Forming Apparatus)

Figure 1:
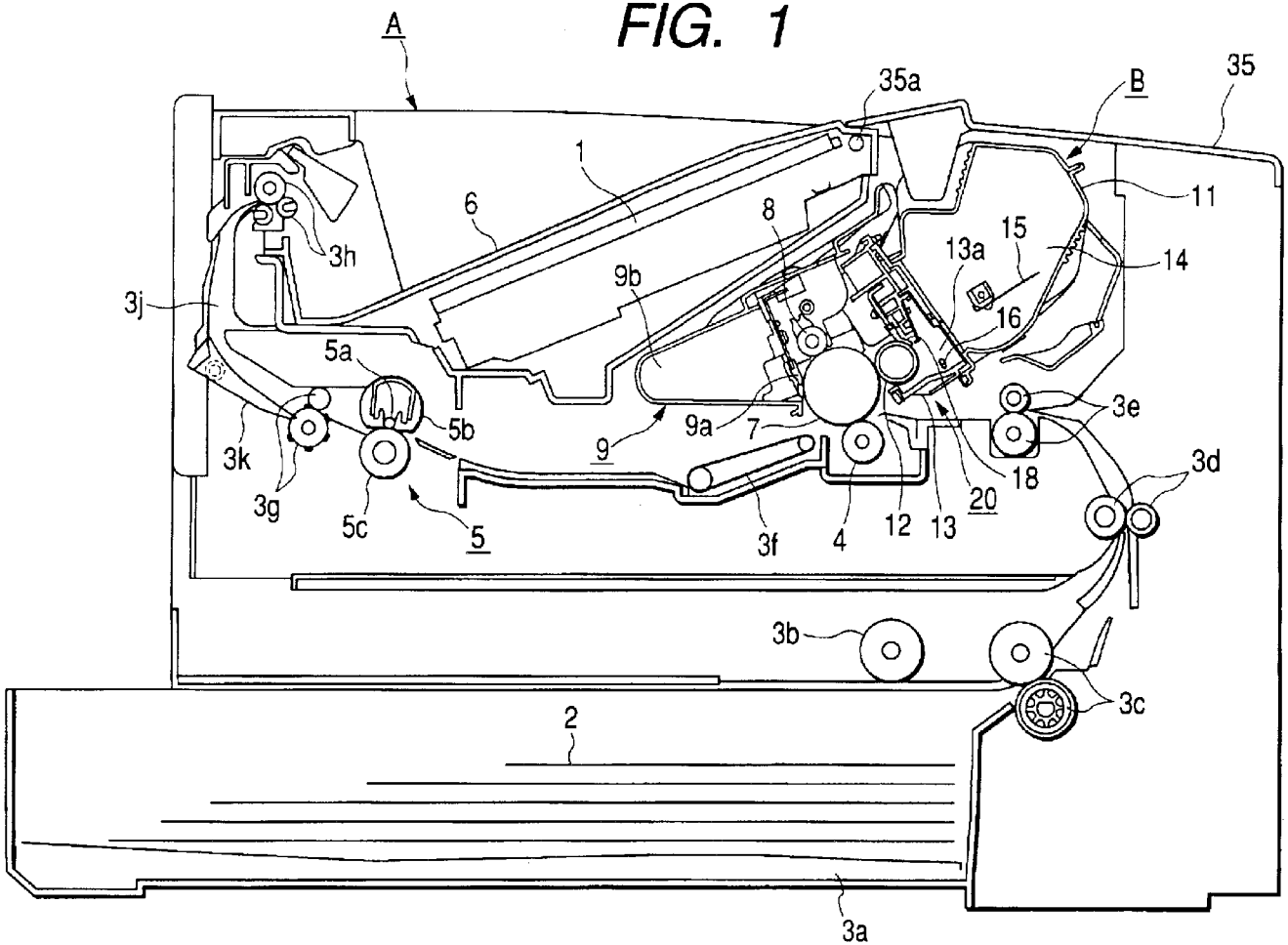
FIG. 1 is a schematic view showing a cross section of an electrophotographic image forming apparatus according to the present invention.
Figure 2:
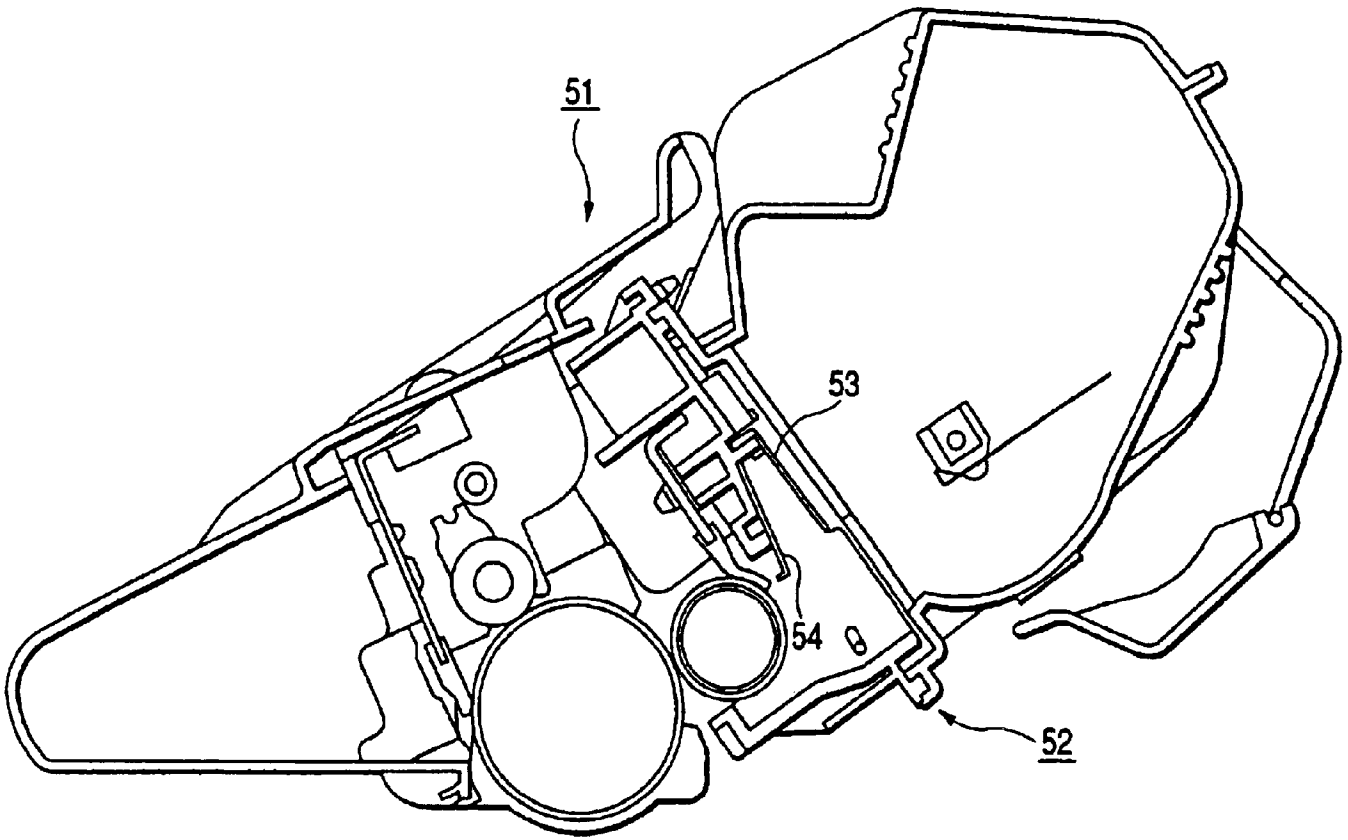
FIG. 2 PRIOR ART
FIG. 2 is a cross sectional view of a conventional process cartridge.
Figure 3:
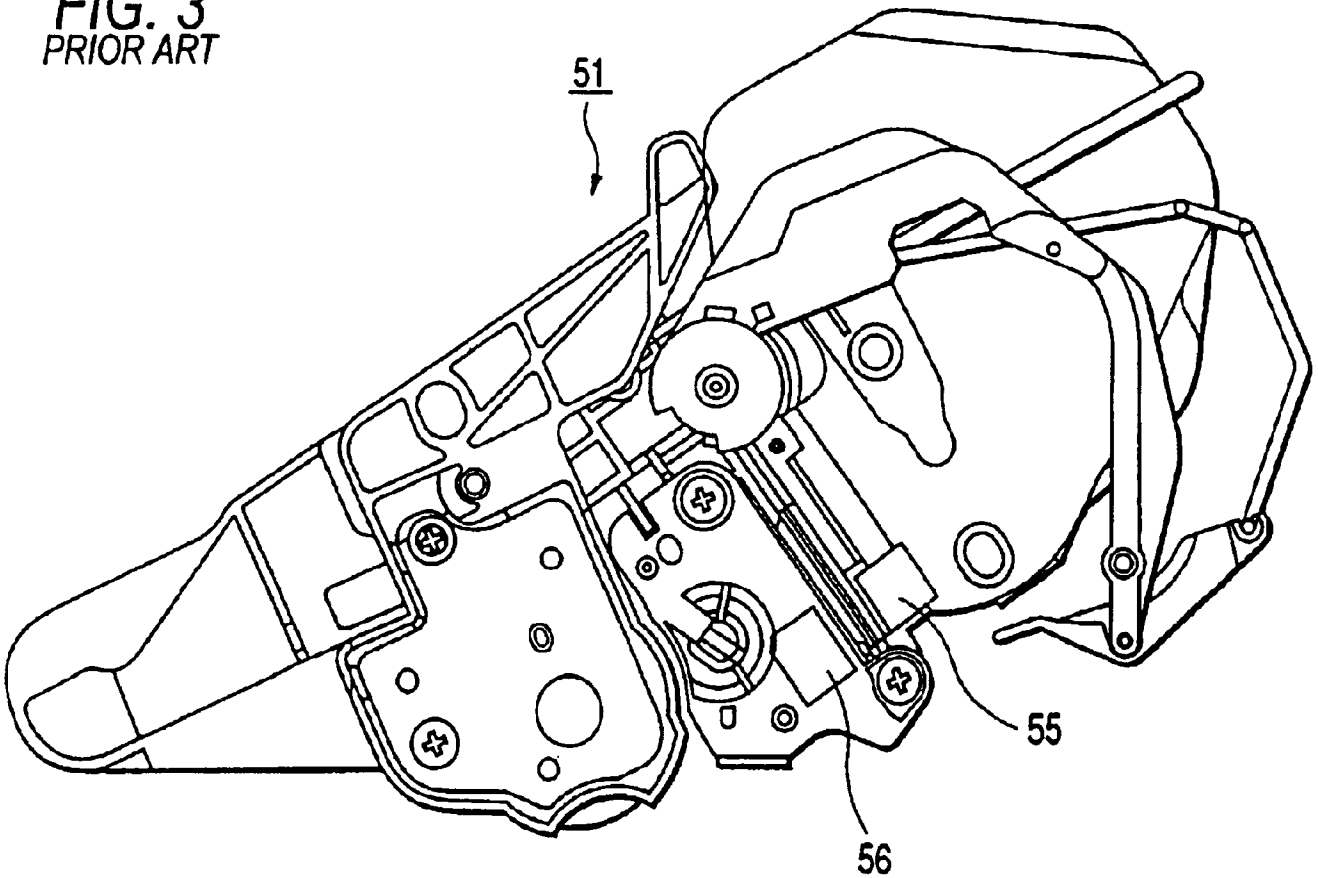
FIG. 3 PRIOR ART
FIG. 3 is a side view of the conventional process cartridge.
Figure 4:
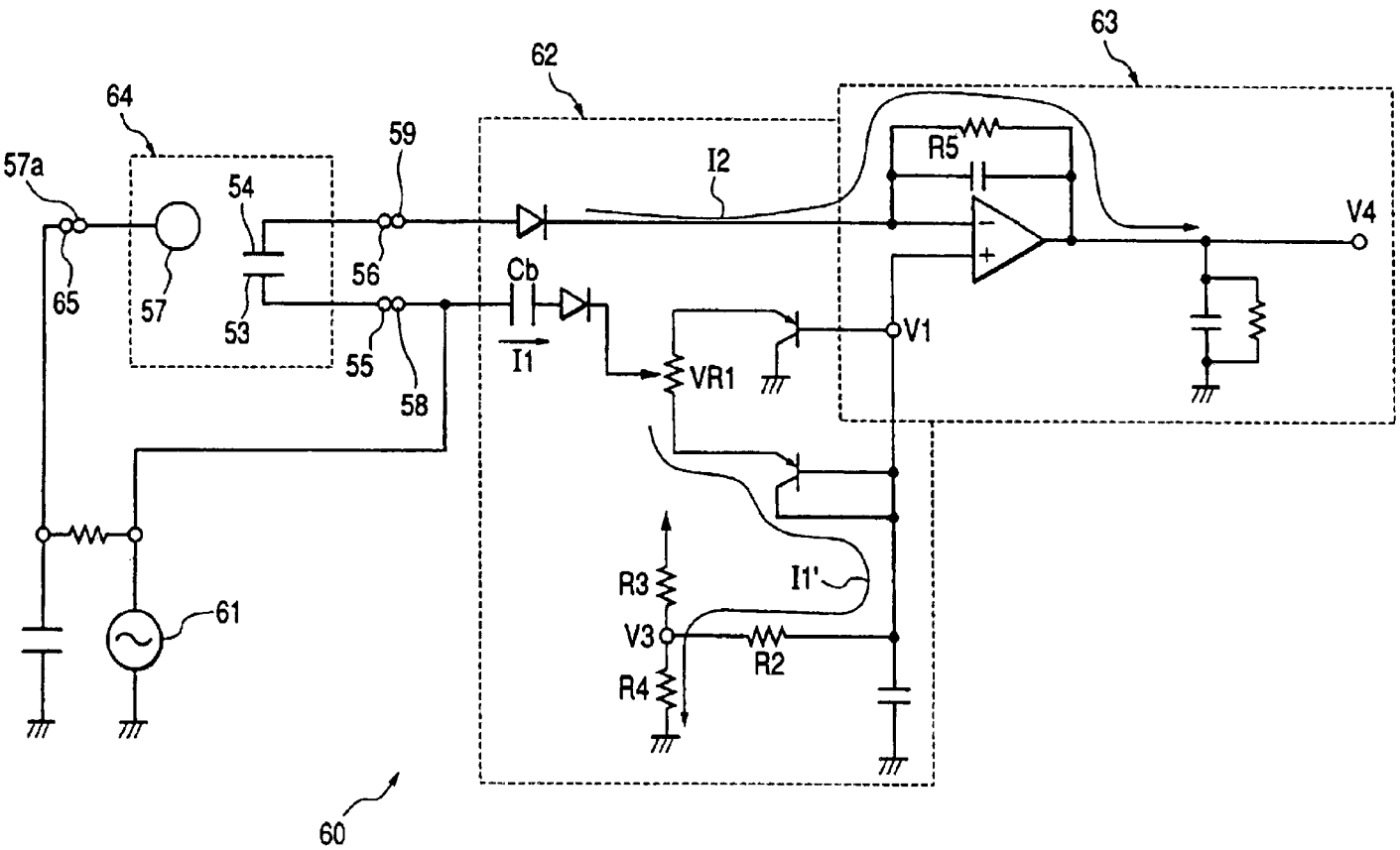
FIG. 4 PRIOR ART
FIG. 4 is a circuit diagram showing an example of a toner-amount detecting circuit of the conventional process cartridge.
Figure 5:
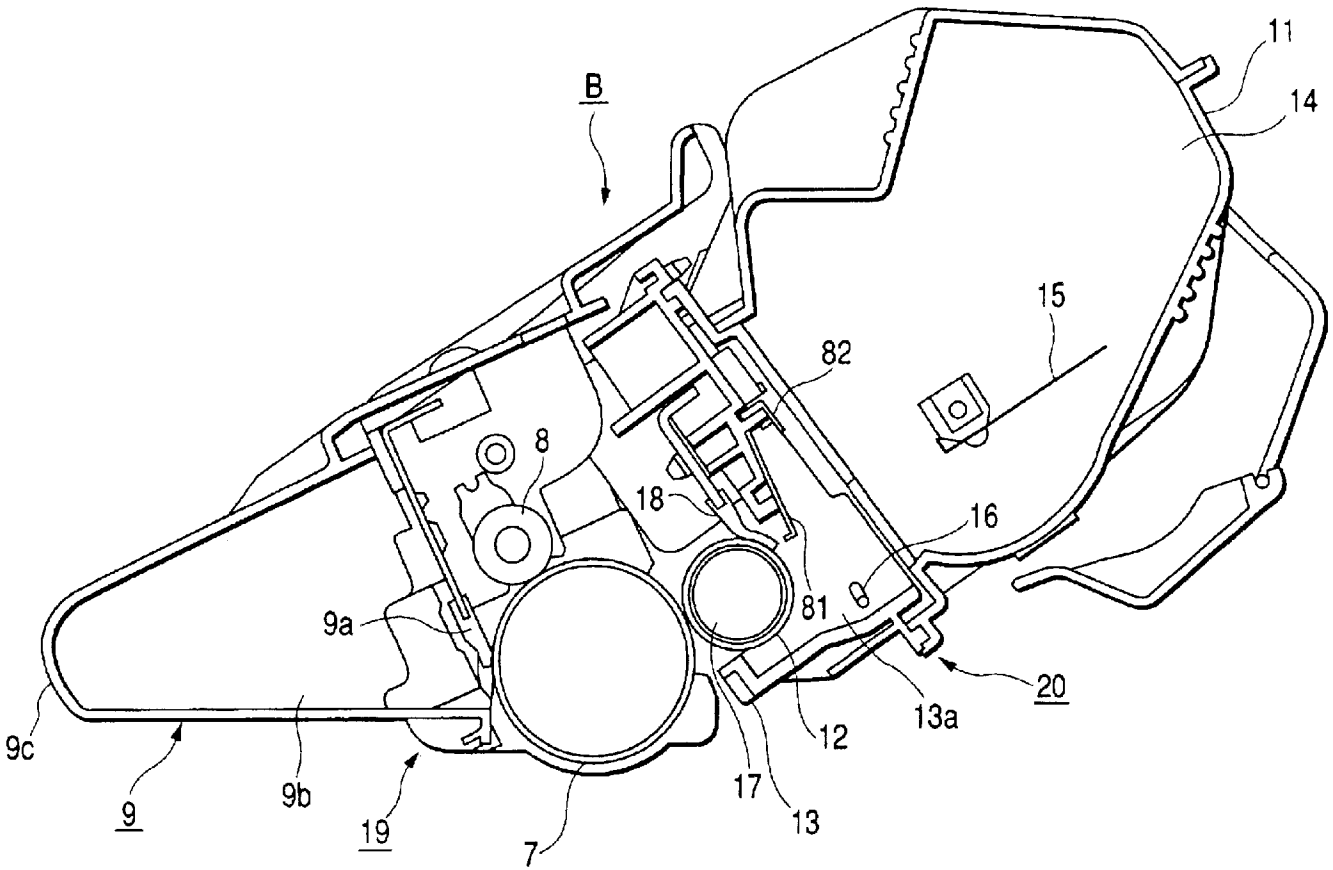
FIG. 5 is a cross sectional view of a process cartridge according to Embodiment 1 of the present invention.

First, a description will be provided of an embodiment of an image forming apparatus that can be mounted with a process cartridge having a structure according to the present invention. FIG. 1 is a cross sectional view of an electrophotographic image forming apparatus A according to this embodiment. FIG. 5 is a cross sectional view of a process cartridge B.

The image forming apparatus A includes an electrophotographic photosensitive member having a drum shape, that is, a photosensitive drum 7. The photosensitive drum 7 is charged by a charging roller 8 serving as charging means. Then, the drum 7 is irradiated by laser light corresponding to image information from optical means 1 including a laser diode, a polygon mirror, a lens, and a reflecting mirror, so that a latent image corresponding to the image information is formed on the photosensitive drum 7. The latent image is developed by developing means to be formed into a visible image, that is, a toner image.

The developing means is composed of a developing sleeve 12 serving as a developer-bearing member for sending out toner to the photosensitive drum 7 and a developing blade 18 serving as a regulating member for regulating the amount of a developer adhering to a surface of the developing sleeve 12. A developing unit 20 is constituted as a developing device by combining the developing sleeve 12, the developing blade 18, a developing frame 13 for holding the developing sleeve 12 and the developing blade 18, and a toner container 11 (also referred to as a developer frame) for containing the developer.

The developing frame 13 includes a developing chamber 13*a*. Toner inside a toner-containing portion 14 adjacent to the developing chamber 13*a* is sent out to the developing sleeve 12 in the developing chamber 13*a* by rotation of a toner-feeding member 15. The developing frame 13 includes a toner-agitating member 16 that is rotatably provided in the vicinity of the developing sleeve 12. The toner-agitating member 16 circulates the toner inside the developing chamber 13*a*, which has been sent out from the toner-containing portion 14. Further, the toner has magnetic property and the developing sleeve 12 has a stationary magnet 17 incorporated thereinto, so that the toner adheres onto the developing sleeve 12.

After that, the developing sleeve 12 is rotated to carry the toner. By means of the developing blade 18, a triboelectric charge is imparted to the toner, while a toner layer having a predetermined thickness is formed on the developing sleeve 12 to be fed to a developing region of the photosensitive drum 7. The toner supplied to the developing region is next transported to the latent image on the photosensitive drum 7 to form the toner image on the photosensitive drum 7. Note that the developing sleeve 12 is connected to a developing-bias circuit provided to the image forming apparatus A, and a developing-bias voltage obtained by superimposing a DC voltage on an AC voltage is normally applied to the developing sleeve 12.

On the other hand, in synchronization with the formation of the toner image, a recording medium 2 set in a sheet-feeding cassette 3*a* is transported to a transfer position by a pickup roller 3*b* and transport-roller pairs 3*c*, 3*d*, and 3*e*. In the transfer position, a transfer roller 4, serving as transfer means, is arranged, and a voltage is applied to the transfer roller 4, so that the toner image on the photosensitive drum 7 is transferred onto the recording medium 2.

The recording medium 2 onto which the toner image has been transferred is transported to fixing means 5 by a transport guide 3*f*. The fixing means 5 is composed of a driving roller 5*c* and a fixing roller 5*b* that has a heater 5*a* built therein, and applies heat and pressure to the recording medium 2 passing therethrough to fix the transferred toner image to the recording medium 2.

The recording medium 2 is transported by delivery-roller pairs 3*g* and 3*h* and then delivered to a delivery tray 6 via a surface reverse path 3*j*. The delivery tray 6 is provided on an upper surface of the image forming apparatus A. Alternatively, it is possible to operate a flapper 3*k* capable of oscillating to deliver the recording medium 2 without passing through the surface-reverse path 3*j*. In this embodiment, transport means is composed of the pickup roller 3*b*, the transport-roller pairs 3*c*, 3*d*, and 3*e*, the transport guide 3*f*, and the delivery-roller pairs 3*g* and 3*h*.

After the toner image is transferred onto the recording medium 2 by the transfer roller 4, the residual toner is removed from the photosensitive drum 7 by 5 cleaning means 9, making the photosensitive drum 7 available for the following image forming process. In the cleaning means 9, the residual toner is scraped off from the surface of the photosensitive drum 7 by an elastic cleaning blade 9*a* that is arranged so as to abut against the photosensitive drum 7, and then collected into a waste-toner reservoir 9*b*.

(Description of Process Cartridge)

In this embodiment, as shown in FIG. 5, the process cartridge B has the developing frame 13 provided with the developing means and the toner container 11, which are welded together to be integrally formed into the developing unit 20 (developing device). The toner container 11 has the toner-containing portion 14 for containing toner formed therein and the toner-feeding member 15 supported rotatably inside the toner-containing portion 14. The developing frame 13 holds the developing sleeve 12 and the developing blade 18, which serve as the developing means.

In addition, the cleaning means 9, such as the cleaning blade 9*a*, the photosensitive drum 7, and the charging roller 8, are supported by a cleaning frame 9*c* to form the cleaning unit 19.

The process cartridge B is constituted as a cartridge by combining and integrating the developing unit 20 and the cleaning unit 19.

Figure 6:
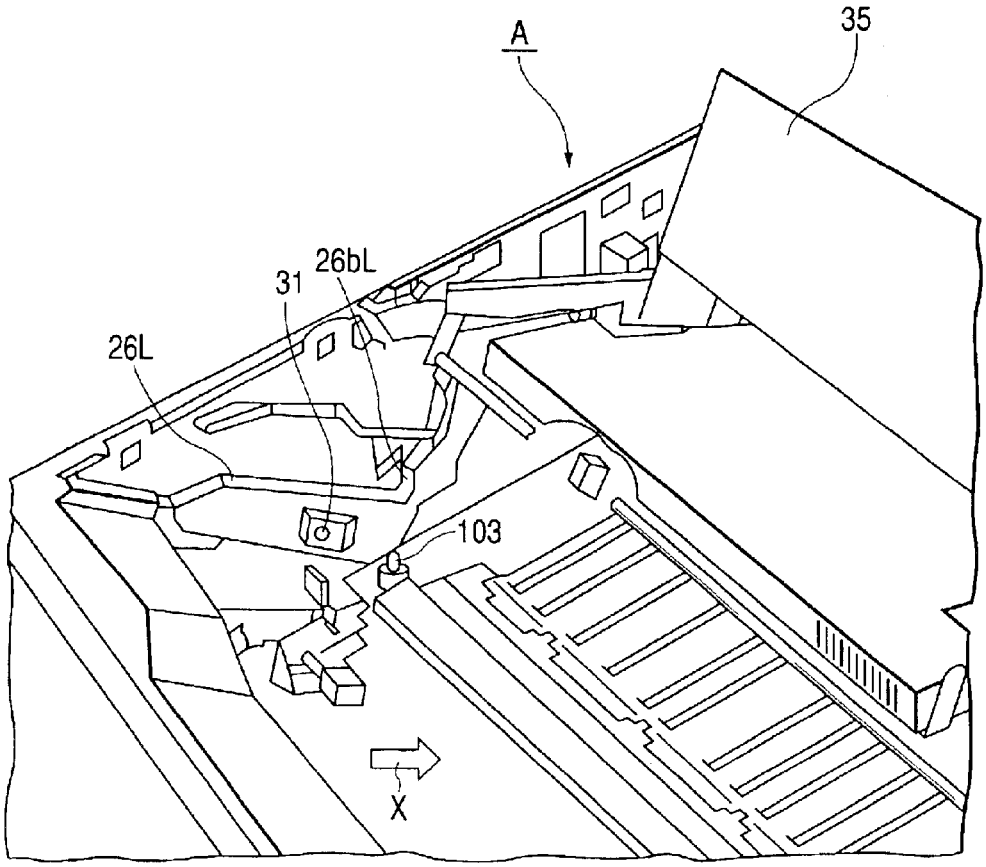
FIG. 6 is a perspective view showing a state in which an openable and closable member of the electrophotographic image forming apparatus is opened.

Next, a description will be provided of a method of mounting and detaching the process cartridge B to and from the image forming apparatus main body with reference to FIG. 6. FIG. 6 is a perspective view showing a state in which an openable and closable member 35 of the image forming apparatus A is opened. When the openable and closable member 35 of the image forming apparatus A is opened about a hinge 35*a* (refer to FIG. 1), there can be observed a left forwardly-positioned descent guide rail 26L and a right, forwardly-positioned descent guide rail (not shown) on the left and right inner walls of the image forming apparatus A, respectively. Then, inserted along the left guide rail 26L and the right guide rail are left and right cylindrical guides provided to the process cartridge B coaxially with the photosensitive drum 7 and elongated positioning guides provided thereto on a rear side of the cylindrical guides when viewed from a direction for mounting the process cartridge B to the apparatus main body. By fitting the left cylindrical guide into a left positioning groove 26*b*L by positioning the right cylindrical guide in a right positioning groove (not shown) of the image forming apparatus A, the process cartridge B is mounted to the image forming apparatus A.

Conversely, the process cartridge B mounted to the image forming apparatus A is detached therefrom by pulling out the process cartridge B along the left guide rail 26L and the right guide rail following the reverse of the above procedure.

In addition, in this embodiment, the process cartridge B includes toner-amount detecting means for detecting a residual toner amount in accordance with consumption of the toner inside the developing chamber 13*a*.

(Description of Toner-Amount Detecting Means)

In this embodiment, as shown in FIG. 5, a first electrode 81 and a second electrode 82 are provided to the developing frame 13 as measuring electrode members that constitute the toner-amount detecting means, and are arranged in parallel to each other along the developing sleeve 12. The first electrode 81 is provided in the vicinity of and along the developing sleeve 12.

The second electrode 82 is provided closer to the toner container 11 than the first electrode 81 and arranged on an upper portion of the developing frame 13 so as to be opposed to the first electrode 81.

The toner-amount detecting means is structured such that a voltage is applied to one of the first electrode 81 and the second electrode 82 to induce a capacitance between the electrodes and the capacitance is measured by a detecting circuit provided to the image forming apparatus A, thereby detecting the toner amount.

That is, due to admission of the toner between the electrodes, the capacitance between the electrodes is changed, so that the change is detected to enable the toner-amount detection.

In this embodiment, a voltage is applied to the second electrode 82 to set the second electrode 82 and the first electrode 81 as an input side and an output side, respectively.

The first electrode 81 and the second electrode 82 are arranged in a position to which the toner fed from the toner container 11 by the toner-feeding member 15 is admitted. When the toner amount inside the process cartridge B is large, the toner is forced into a space surrounded by the respective electrodes by the toner feeding member 15. Thus, the capacitance between the electrodes maintains a high value. As the process cartridge B continues to be used, the toner is further consumed, the depth of the toner between the electrodes becomes smaller, and the capacitance between the electrodes becomes lower as well. Based on the reduction of the capacitance, the toner amount can be detected successively.

Finally, the toner in the vicinity of the tip of the developing blade 18 for scraping off the toner from the surface of the developing sleeve 12 is consumed, thereby causing a blank area on the image and bringing about an out-of-toner state. In this embodiment, the developing-bias voltage applied to the developing sleeve 12 is set as an input voltage to detect the capacitance between the developing sleeve 12 and the first electrode 81 as well, thereby enabling the detection of the out-of-toner state. That is, the detecting means detects the change in the capacitance, thereby enabling the successive detection of the toner amount.

(Description of Detecting Circuit)

Figure 7:
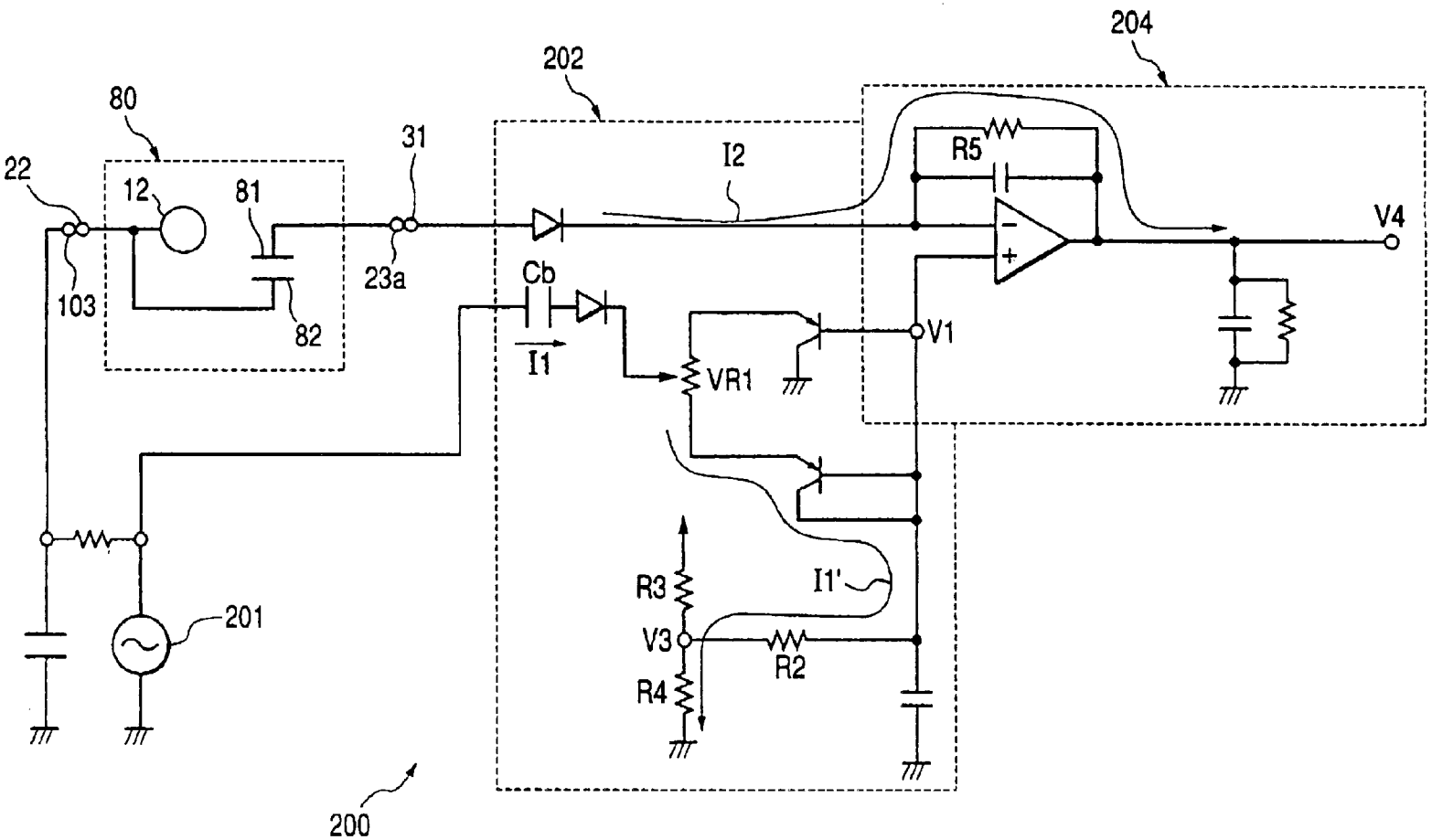
FIG. 7 is a circuit diagram showing a toner-amount detecting circuit of a process cartridge of the present invention.

FIG. 7 is a diagram showing an example of a toner-amount detecting circuit in an image forming apparatus.

A toner-amount detecting circuit 200 is composed of a detecting portion 80, a developing-bias circuit 201, a control circuit 202, and an amplifying circuit 204. The detecting portion 80 is composed of the first electrode 81, the second electrode 82, and the developing sleeve 12, and induces a capacitance in order to detect the toner amount. The detecting portion 80 is provided to the process cartridge B.

On the other hand, the developing-bias circuit 201, the control circuit 202, and the amplifying circuit 204 are provided to the image forming apparatus A main body.

The process cartridge B includes a developing-bias electrode 22 electrically connected to the developing sleeve 12. The image forming apparatus A includes an electrical contact 103 electrically connected to the developing-bias circuit 201. When the process cartridge B is mounted to the image forming apparatus A, the developing-bias electrode 22 and the electrical contact 103 that is provided to the image forming apparatus A are electrically connected to each other, and a developing-bias voltage is applied to the developing sleeve 12 from the developing-bias circuit 201 of the image forming apparatus A via the electrical contact 103 and the developing-bias electrode 22.

Also, provided on the side surface of the frame of the process cartridge B is an external contact 23*a* to be electrically connected to the image forming apparatus A. When the process cartridge B is mounted to the image forming apparatus main body, the external contact 23*a* is brought into contact with an electrical contact 31 provided to the image forming apparatus A.

The detecting portion 80 functions as an impedance element. The second electrode 82 in this embodiment, which serves as an input-side electrode of the detecting portion 80, is connected to the developing-bias circuit 201 as developing-bias application means via the developing-bias electrode 22.

The first electrode 81 in this embodiment, which serves as an output-side electrode of the detecting portion 80, is connected to the control circuit 202 of the toner-amount detecting circuit 200. In this embodiment, the first electrode 81 is connected to the control circuit 202 via the external contact 23*a* and the electrical contact 31 of the apparatus main body.

That is, the developing-bias voltage is set as the input voltage, and the detecting portion 80 detects the toner amount by detecting the capacitance induced between the developing sleeve 12 or the second electrode 82 and the first electrode 81.

The control circuit 202 includes a reference-capacitive element Cb, and the reference-capactive element Cb is connected to the developing-bias circuit 201 in the image forming apparatus A. The reference-capacitive element Cb sets a reference voltage V1 for the toner-amount detection by using an AC current 11 applied from the developing-bias circuit 201. In the control circuit 202, the AC current 11 applied to the reference-capactive element Cb is divided at the variable resistor (volume) VR1, and a value of the amount of voltage drop caused by a resistor R2 due to the divided AC current I1' is added to a value V3 set by resistors R3 and R4 to determine the reference voltage V1.

The amplifying circuit 204 includes a comparator for calculating the difference between voltages. An AC current 12 applied to the detecting portion 80 is inputted to the amplifying circuit 204 and outputted as a toner-amount detection value V4 (which is V1−I2×R5). The output value is utilized as a toner-residual-amount detection value.

According to the image forming apparatus of the present invention, the residual-toner amount in the process cartridge is successively detected. By displaying the amount of the consumed toner based on the detection information, it is possible to prompt a user to prepare a new process cartridge or a replenishment cartridge. Further, based on the detection information on the out-of-toner state, it is possible to prompt the user to replace the process cartridge or replenish the toner.

In the present invention, as described above, the input voltage to the second electrode 82 included in the detecting portion 80 is set as a developing bias. Thus, there is obtained a structure such that the input voltage is applied to the second electrode 82 from the image forming apparatus main body via the electrical contact 103 and the developing-bias electrode 22. The structure avoids the necessity for separately providing an electrical contact for input to the second electrode 82 to the process cartridge B. As a result, the parts of the image forming apparatus main body and the process cartridge B including the electrical contacts can be reduced in number, thereby enabling the downsizing of the apparatus and a reduction in costs.

Figure 8:
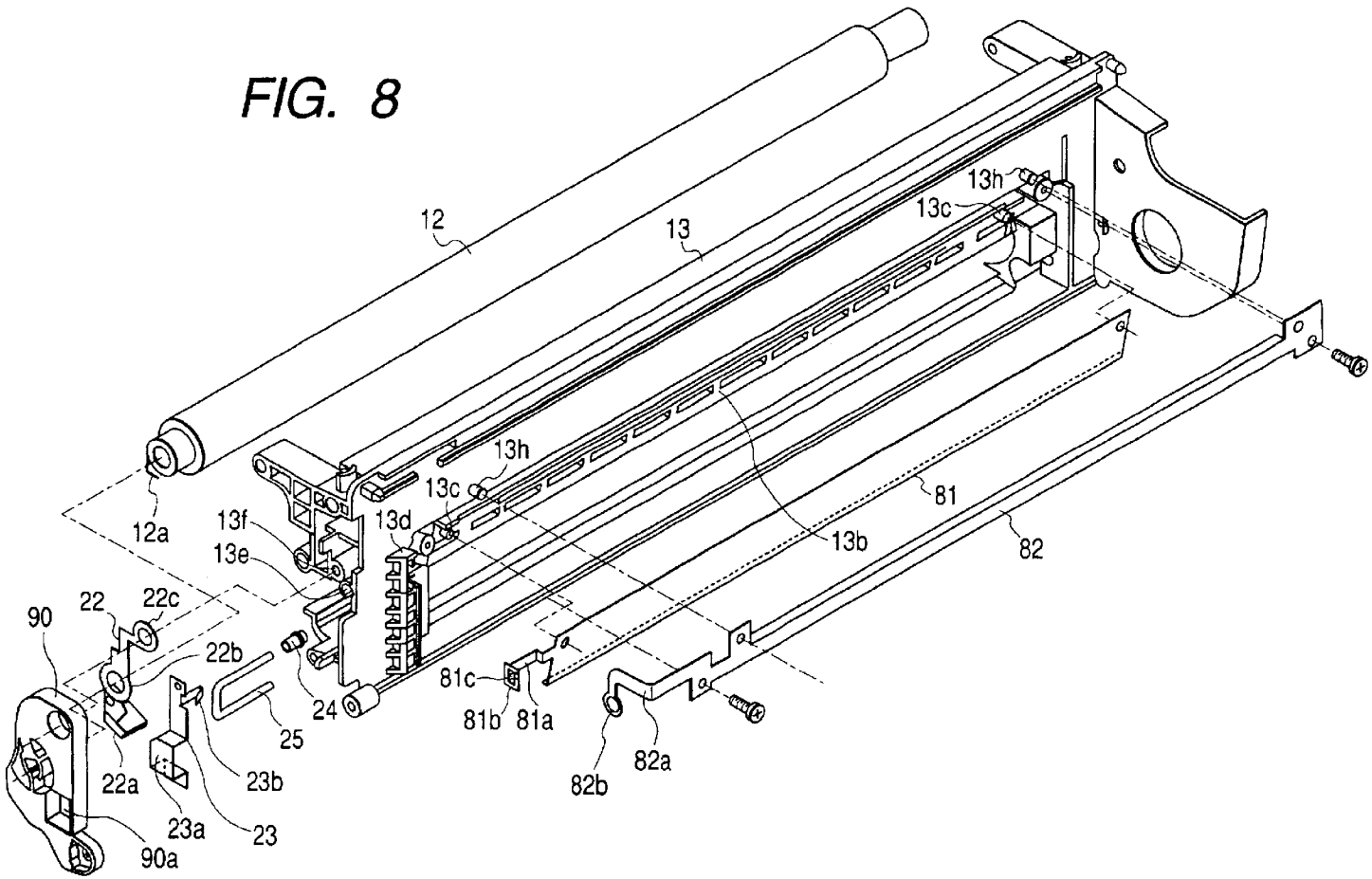
FIG. 8 is a perspective view showing how a toner-amount detecting electrode according to Embodiment 1 of the present invention is attached to a developing frame.

Next, a description will be provided of a structure for attaching the toner-amount detecting means to the first electrode 81 and the second electrode 82 constituting the developing device. The toner-amount detecting means using the first electrode 81 and the second electrode 82 is based on the detection of the capacitance of the space surrounded by the first electrode 81 and the second electrode 82. Therefore, it is extremely important to maintain the accurate positions of the respective electrodes. Also, the object of the present invention is to accurately detect the timing at which the out-of-toner state occurs, causing a blank area on the image. Therefore, the respective electrodes should be arranged in the vicinity of the developing sleeve 12 where the toner is more likely to remain. Accordingly, in this embodiment, as shown in FIG. 8, the first electrode 81 and the second electrode 82 are attached to the developing frame 13.

(Description of Structure for Attaching Electrodes)

The first electrode 81 is positioned by positioning bosses 13*c* provided in an attachment surface 13*b* of the developing frame 13, and attached to the attachment surface 13*b* by using an adhesive double-coated tape. An arm 81*a* is provided on one end of the first electrode 81, and an end portion of the arm 81*a* is formed into an incised clinch 81*b*. When the first electrode 81 is attached to the developing frame 13, the incised clinch 81*b* becomes embedded in a groove 13*d* of the developing frame 13. On the other hand, a hole 13*e* that penetrates from the inside to the outside of the frame is formed beside the groove 13*d* of the developing frame 13 and is aligned with a hole 81*c* of the incised clinch 81*b*. Also, the hole 13*e* of the developing frame 13 is formed into a shape into which an elastic seal member 24 is fitted, and the elastic seal member 24 is press-fitted thereinto from the outside of the developing frame 13. After that, an electrode rod 25 is inserted into the developing frame 13 via the elastic seal member 24 and press-fitted into the incised clinch 81*b* of the first electrode 81 inside the frame. Accordingly, the first electrode 81 and the electrode rod 25 are electrically connected to each other.

The second electrode 82 is positioned by positioning bosses 13*h* of the developing frame 13 and fixed by using screws. An arm 82*a* is provided on one end of the second electrode 82, and an end portion of the arm 82*a* has a hole 82*b* that is aligned with a screw hole 13*f* formed in a side surface of the developing frame 13.

As shown in FIG. 8, attached in a side portion of the developing frame 13 is a holder 90 for rotatably supporting the developing sleeve 12 via a bearing. An electrode plate 23 and the developing-bias electrode 22 are attached to the holder 90. The electrode plate 23 electrically connects the image forming apparatus and the process cartridge B. The developing-bias electrode 22 serves to supply the developing-bias voltage to the developing sleeve 12.

A part of the electrode plate 23 is fitted into a square-shaped window 90*a* formed in the holder 90, thereby forming an external contact 23*a* for electrically connecting the image forming apparatus A and the process cartridge B. The electrode plate 23 has a contact portion 23*b*. When the holder 90 is attached to the developing frame 13, the contact portion 23*b* is brought into contact with the electrode rod 25. Accordingly, the external contact 23*a* is electrically connected to the first electrode 81.

Further, the developing-bias electrode 22 is attached to the holder 90, thereby forming an external contact 22*a* for electrically connecting the image forming apparatus A and the developing sleeve 12. The develoing-bias electrode 22 has a contact portion 22*b* and a contact portion 22*c*. When the holder 90 is attached to the developing frame 13, the contact portion 22*b* is brought into contact with a sleeve electrode 12*a* attached to the developing sleeve 12, and the contact portion 22*c* and the hole 82*b* of the second electrode 82 are fastened to each other by using a screw to be electrically connected to each other.

Figure 9:
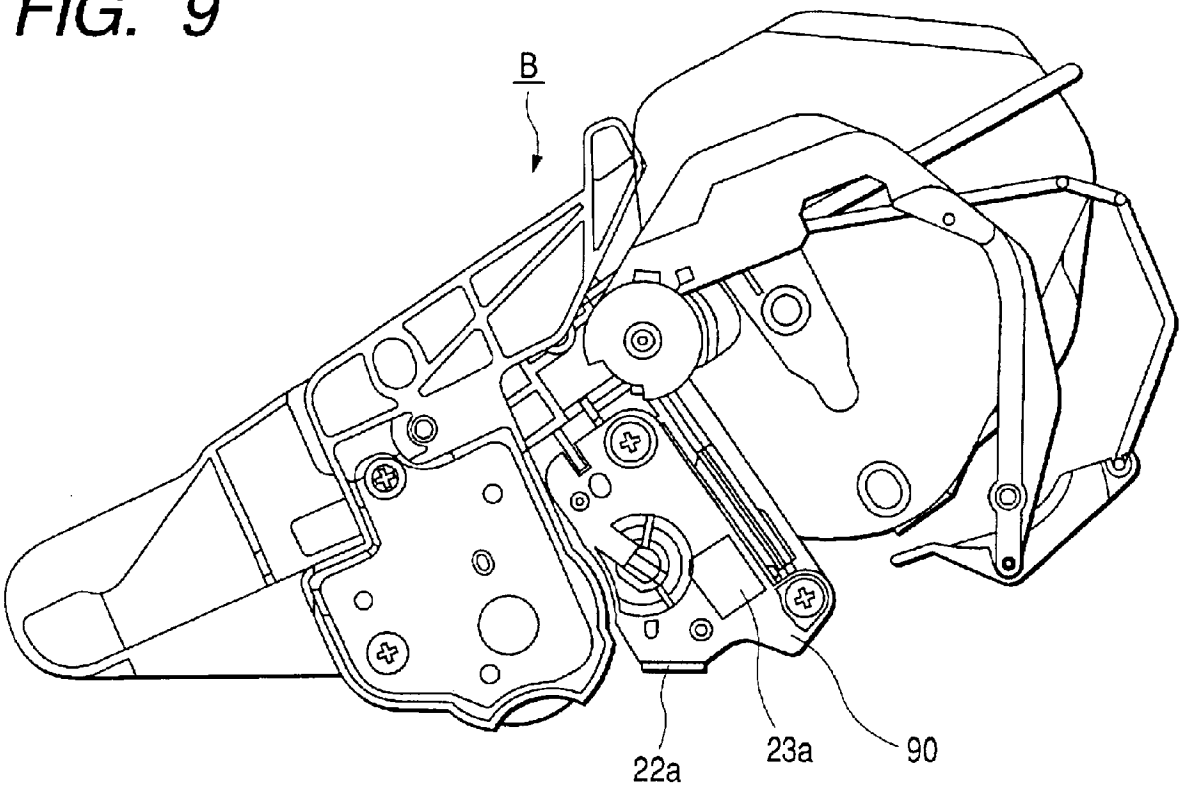
FIG. 9 is a side view of the process cartridge according to Embodiment 1 of the present invention.
Figure 10:
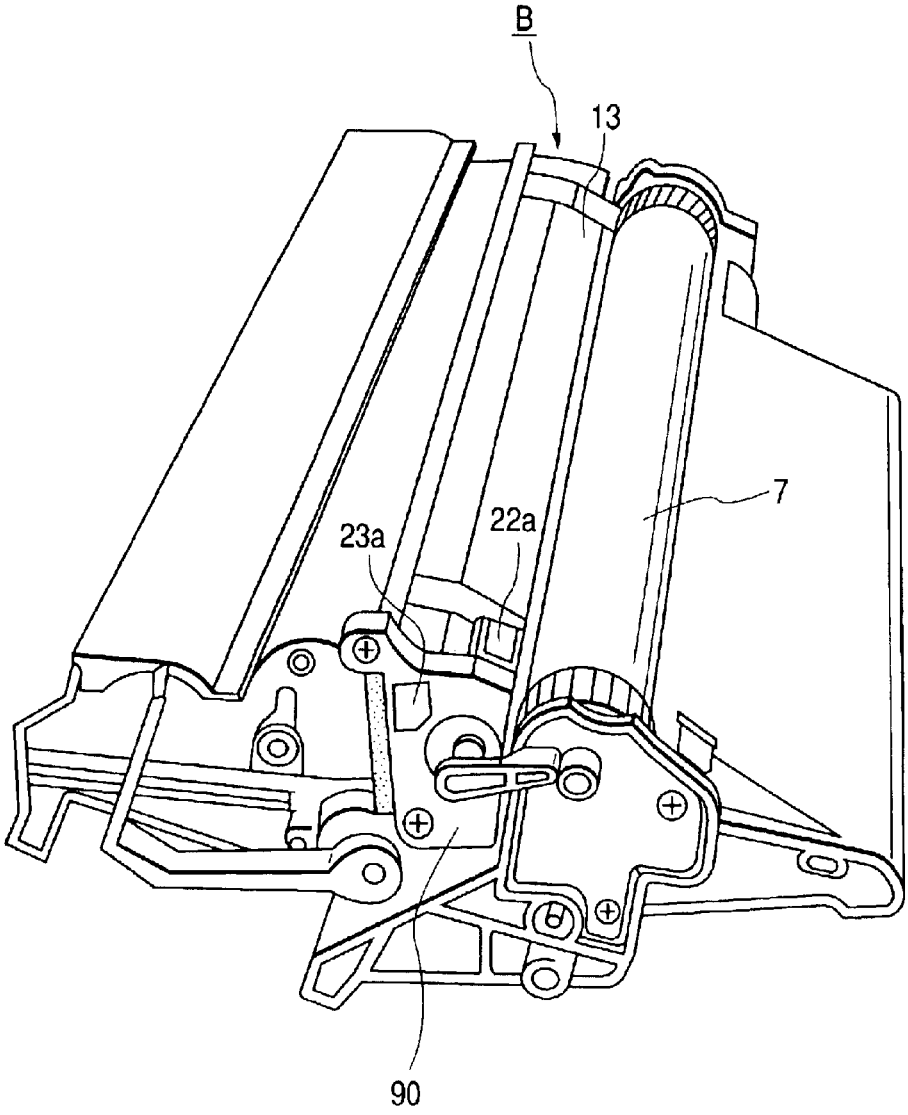
FIG. 10 is a perspective view as viewed from a lower side of the process cartridge according to Embodiment 1 of the present invention.

In the process cartridge B assembled from the respective parts, the external contact 22*a* of the developing-bias electrode 22 and the external contact 23*a* of the toner-amount detecting means are arranged as shown in FIGS. 9 and 10. That is, the external contact 22*a* of the developing bias electrode 22 is arranged in a bottom surface of the process cartridge B, and the external contact 23*a* of the toner-amount detecting means is arranged in the side surface of the process cartridge B. As shown in FIG. 6, if the process cartridge B is mounted to the image forming apparatus main body in a direction indicated by the arrow X shown in FIG. 6, the external contact 23*a* of the toner-amount detecting means is brought into contact with the electrical contact 31 arranged in an inner side surface of the apparatus main body to be electrically connected thereto. The external contact 22*a* of the developing-bias electrode 22 is brought into contact with the electrical contact 103 protruding from an inner bottom surface of the apparatus main body to be electrically connected thereto.

As described above, in this embodiment, a detection-voltage input contact of the toner-amount detecting means is set to be identical with a contact for supplying the developing-bias voltage. As a result, the parts of the image forming apparatus main body and the process cartridge B including the electrical contacts can be reduced in number, thereby making it possible to achieve the reduction in costs and the downsizing.

In addition, the reduction in the number of the electrical contacts to contact the image forming apparatus main body reduces the fear of contact failure as well, thereby improving the reliability.

Further, the external contact 22*a* of the developing-bias electrode 22 is arranged in the bottom surface of the process cartridge B, so that toner, paper dust, chips of resin caused by mounting or detaching the process cartridge B, and the like hardly adhere to the external contact 22*a*. As a result, the reliability of the contacts can be improved.

(Embodiment 2)

Figure 11:
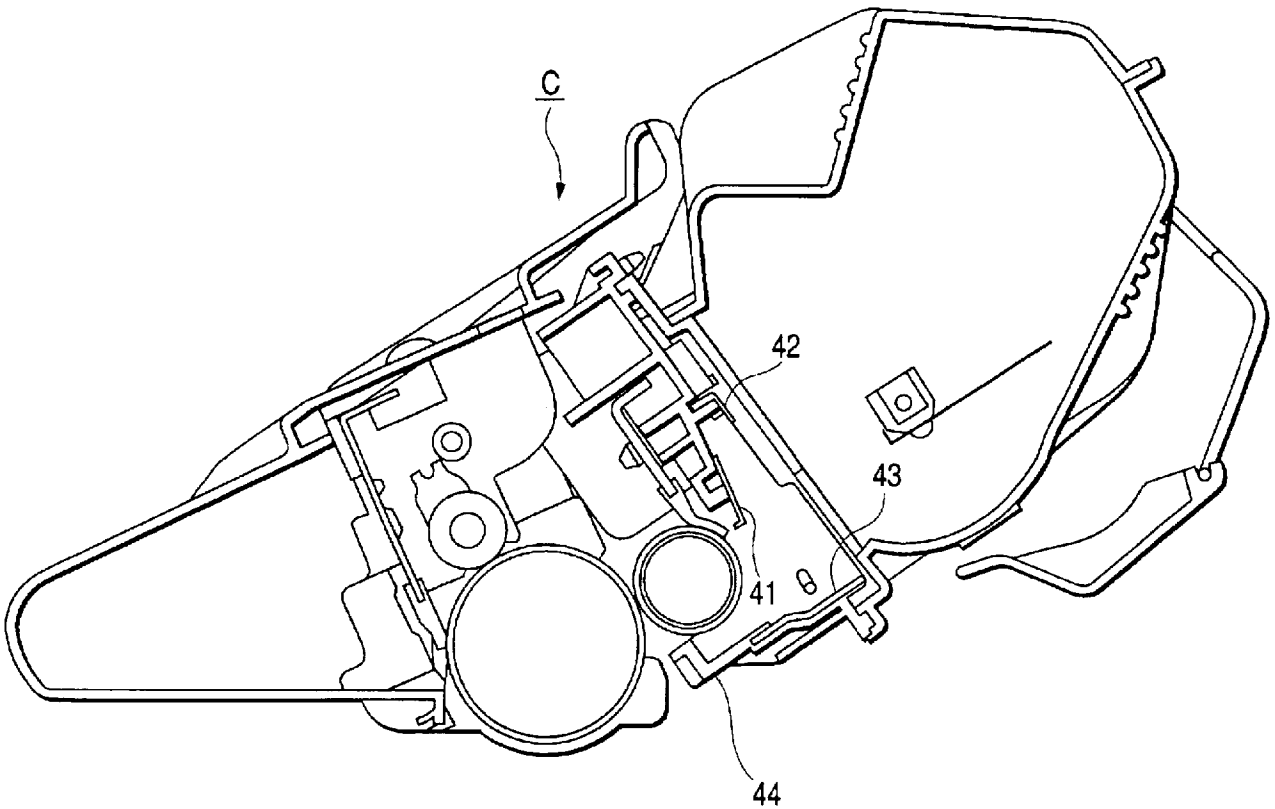
FIG. 11 is a cross sectional view of a process cartridge according to Embodiment 2 of the present invention.

Next, a description will be provided of Embodiment 2. The structure of the image forming apparatus main body is the same as that of Embodiment 1, so that its description will be omitted. FIG. 11 is a cross sectional view of a process cartridge C of this embodiment. The structure relating to image formation is the same as that of Embodiment 1, so that its description will be omitted. The process cartridge C includes a first electrode 41, a second electrode 42, and a third electrode 43 as the toner-amount detecting means, which are arranged in a developing frame 44. The first electrode 41 and the second electrode 42 are the same as in Embodiment 1. The third electrode 43 is provided in a bottom portion of the developing frame 44. The first electrode 41 and the third electrode 43 are electrically connected to each other, each having the same electrical potential.

That is, in the structure of this embodiment, the amount of toner admitted into a space surrounded by the first electrode 41, the second electrode 42, and the third electrode 43 is detected as a change in the capacitance among the respective electrodes, to thereby enable the toner-amount detection. In this embodiment, a voltage is applied to the second electrode 42 to set the second electrode 42 as an input side and to set the first electrode 41 and the third electrode 43 as output sides.

(Description of Structure for Attaching Electrodes)

Figure 12:
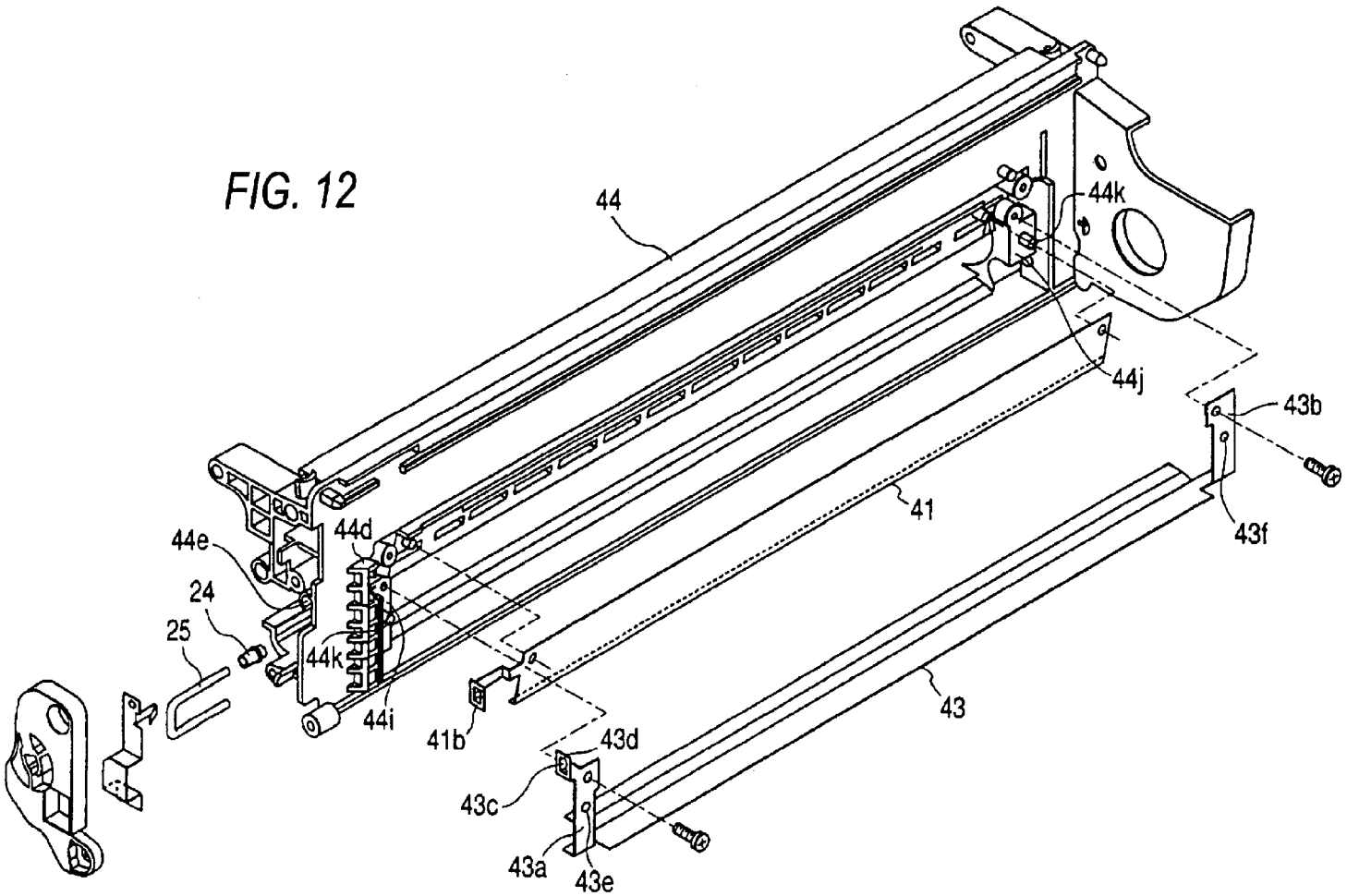
FIG. 12 is a perspective view showing how a toner-amount detecting electrode according to Embodiment 2 of the present invention is attached to a developing frame.

FIG. 12 is a perspective view showing how the first electrode 41 and the third electrode 43 are attached to the developing frame 44.

The structure for attaching the first electrode 41 is the same as that of Embodiment 1, so that its description will be omitted.

The third electrode 43 has a thin plate shape, and an arm 43*a* and an arm 43*b* are formed at both ends of the third electrode 43. The arm 43*a* and the arm 43*b* are formed to bend in a direction approximately perpendicular to a plate surface of the third electrode 43. In the arm 43*a* and the arm 43*b*, there are formed a positioning hole 43*e* and a positioning hole 43*f*, respectively, into which positioning-bosses 44*k* are respectively fitted. Also, in an end portion of the arm 43*a*, an incised clinch 43*c*, having the same shape as an incised clinch 41*b* of the first electrode 41, is formed vertically to a plate surface of the arm 43*a* and the plate surface of the third electrode 43.

In order to attach the third electrode 43 to the developing frame 44, the positioning bosses 44*k* are fitted into the positioning hole 43*e* and the positioning hole 43*f* of the arm 43*a* and the arm 43*b*, respectively, to cause the arms to abut against attachment portions 44*i* and 44*j* of the developing frame 44, respectively. Then, the arms are fixed by using screws.

The end portion of the arm 43*a* having the incised clinch 43*c* at this time is fitted into a groove 44*d* of the developing frame 44. A hole 43*d* is formed in the incised clinch 43*c*. In such a structure, when the third electrode 43 is attached to the developing frame 44, the incised clinch 43*c* and the incised clinch 41*b* are arranged in alignment with each other.

Similarly to Embodiment 1, a hole 44*e* that penetrates from the inside to the outside of the frame is formed beside the groove 44*d* of the developing frame 44 and is aligned with a hole of the incised clinch 41*b* and the hole 43*d* of the incised clinch 43*c*. Also, the hole 44*e* of the developing frame 44 is formed into a shape into which the elastic seal member 24 is fitted, and the elastic seal member 24 is press-fitted thereinto from the outside of the developing frame 44. After that, the electrode rod 25 is inserted into the developing frame 44 via the elastic seal member 24 and press-fitted into the incised clinch 41*b* of the first electrode 41 inside the frame and the incised clinch 43*c* of the third electrode 43. Accordingly, the first electrode 41 and the third electrode 43 are electrically connected to the electrode rod 25.

Figure 13:
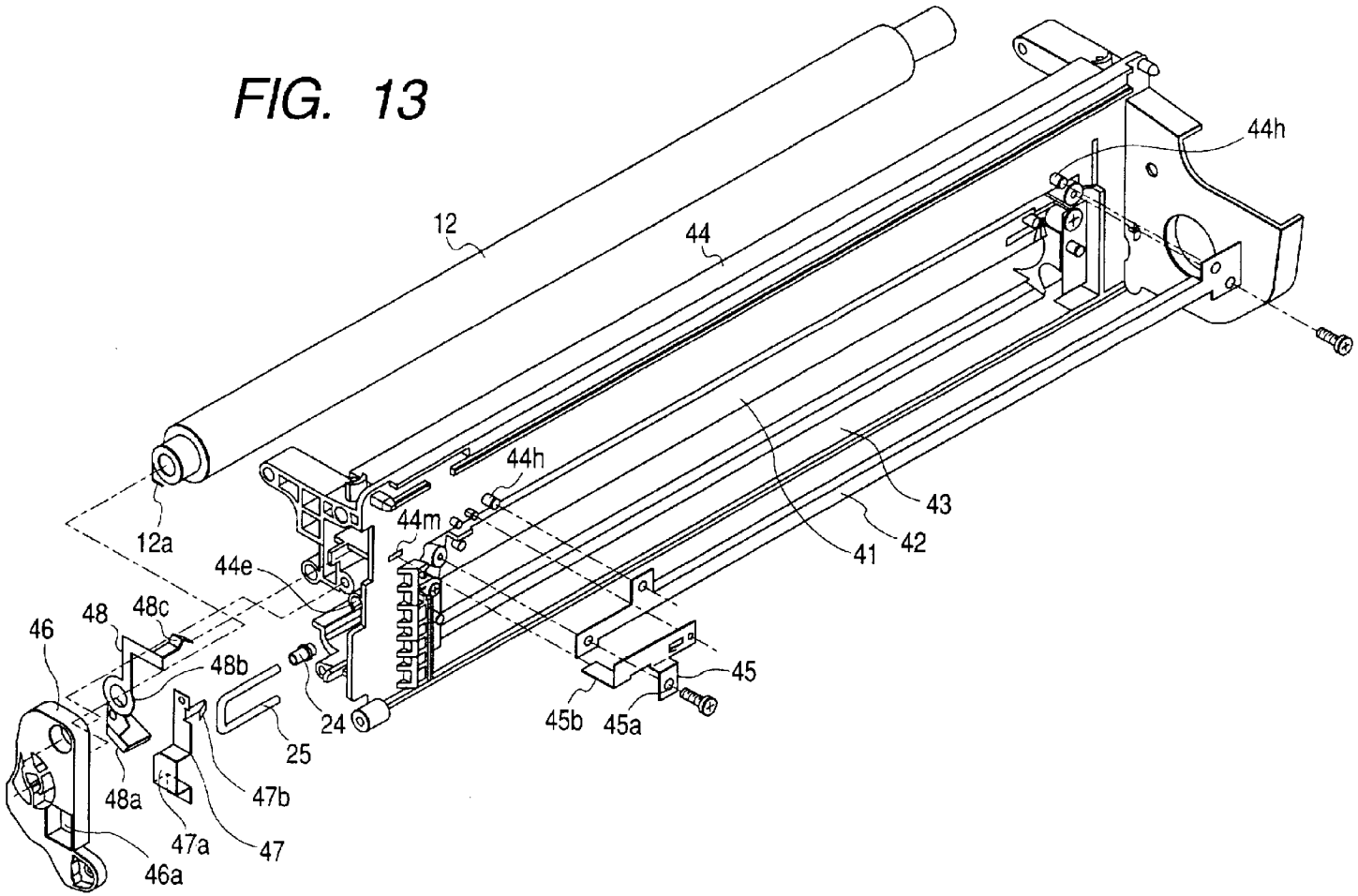
FIG. 13 is a perspective view showing how the toner-amount detecting electrode according to Embodiment 2 of the present invention is attached to the developing frame.

FIG. 13 is a perspective view showing how the second electrode 42 is attached to the developing frame 44. Similarly to Embodiment 1, the second electrode 42 is positioned by fitting positioning bosses 44*h* of the developing frame 44 into positioning holes of the second electrode 42 and fixed by using screws. At this time, a laying electrode 45 and the second electrode 42 are fastened to each other by causing one of the screws to penetrate through a screw hole 45*a* of the laying electrode 45. Therefore, the laying electrode 45 realizes wiring to the outside of the developing frame 44.

A contact portion 45*b* is formed in the laying electrode 45. When the laying electrode 45 is attached to the developing frame 44, the contact portion 45*b* is fitted into a hole 44*m* formed in the developing frame 44.

After that, attached in a side portion of the developing frame 44 is a holder 46 for rotatably supporting the developing sleeve 12 via a bearing. An electrode plate 47 and a developing-bias electrode 48 are attached to the holder 46. The electrode plate 47 electrically connects the image forming apparatus and the process cartridge C. The developing-bias electrode 48 serves to supply the developing-bias voltage to the developing sleeve 12.

A part of the electrode plate 47 is fitted into a square-shaped window 46*a* formed in the holder 46, thereby forming an external contact 47*a* for electrically connecting the image forming apparatus and the process cartridge C. The electrode plate 47 has a contact portion 47*b*. When the holder 46 is attached to the developing frame 44, the contact portion 47*b* is brought into contact with the electrode rod 25. Accordingly, the external contact 47*a* is electrically connected to the first electrode 41 and the third electrode 43.

Further, the developing-bias electrode 48 is attached to the holder 46, thereby forming an external contact 48*a* for electrically connecting the image forming apparatus and the developing sleeve 12. The developing-bias electrode 48 has a contact portion 48*b* and a contact portion 48*c*. When the holder 46 is attached to the developing frame 44, the contact portion 48*b* is brought into contact with the sleeve electrode 12*a* attached to the developing sleeve 12, and the contact portion 48*c* is brought into contact with the contact portion 45*b* of the laying electrode 45, thereby connecting the developing-bias electrode 48 to the sleeve electrode 12*a* and the second electrode 42.

As described in this embodiment, also in the toner-amount detecting means using the first electrode 41, the second electrode 42, and the third electrode 43, two electrodes (the first electrode 41 and the third electrode 43) having the same electrical potential are connected to each other inside the developing frame, and the second electrode 42, serving as the input side electrode, is directly connected to the developing-bias electrode. As a result, the parts of the image forming apparatus main body and the process cartridge including the electrical contacts can be reduced in number.

As described above, according to the developing device and the process cartridge which have the above-mentioned structure, the input of the toner-amount detecting means is applied from the developing-bias electrode. Accordingly, it is possible to eliminate the electrical contacts dedicated to the input to the detecting means and to achieve a reduction in costs and downsizing of the cartridge. Further, the developing-bias electrode is arranged in the bottom surface of the process cartridge. Accordingly, dirt hardly adheres to the electrode, thereby improving the reliability of the contacts.

According to the present invention, the bias that is applied to the developing sleeve for developing the latent image formed on the electrophotographic photosensitive member and the electrode serving to detect the amount of the developer used for developing the latent image on the developing sleeve can be received from the image forming apparatus main body by common electrical contacts.

While the invention has been described with reference to the structure disclosed herein, it is not confined to the details set forth and this application is intended to cover such modifications or changes as may come within the purposes of the improvements or the scope of the following claims.

What is claimed is:

1. A developing device mountable to an electrophotographic image forming apparatus main body to be used for developing an electrostatic latent image formed on an electrophotographic photosensitive member, comprising:

a developing sleeve configured and positioned to develop the electrostatic latent image formed on the electrophotographic photosensitive member;

a first electrode;

a second electrode opposed to said first electrode; and an electrical contact portion configured and positioned to receive a bias to be applied to said developing sleeve and said second electrode from the electrophotographic image forming apparatus main body, wherein said first electrode and said second electrode are arranged in positions at which a developer can be admitted therebetween so that a value corresponding to a capacitance between said first electrode and said second electrode which exists at the time of applying a voltage to said second electrode is detectable by the electrophotographic image forming apparatus main body, thereby permitting the electrophotographic image forming apparatus main body to detect the amount of developer in said developing device.

2. A developing device according to claim 1, wherein the value corresponding to the capacitance between said first electrode and said second electrode and a value corresponding to the capacitance between said first electrode and said developing sleeve which exists at the time of applying the bias to said developing sleeve are detectable by the electrophotographic image forming apparatus main body, thereby permitting the electrophotographic image forming apparatus main body to detect the developer amount in said developing device.

3. A developing device according to claim 1 or 2, further comprising a laying electrode that is electrically connected to said second electrode, wherein said electrical contact portion is electrically connected to said laying electrode.

4. A developing device according to claim 3, wherein said electrical contact portion is arranged in a bottom surface of said developing device.

5. A developing device according to claim 1 or 2, further comprising a third electrode configured and positioned to detect the developer amount in said developing device, wherein said third electrode is electrically connected to said first electrode to have the same electrical potential as said first electrode.

6. A developing device according to claim 1 or 2, wherein said electrical contact portion is integrally provided with a transmitting-to-developing-sleeve portion configured and positioned to transmit the bias, which is received by said electrical contact portion from the electrophotographic image forming apparatus main body, to said developing sleeve, and a transmitting-to-second-electrode portion configured and positioned to transmit the bias to said second electrode.

7. A developing device according to claim 6, wherein said electrical contact portion, said transmitting-to-developing-sleeve portion, and said transmitting-to-second-electrode portion are integrally arranged in the stated order.

8. A process cartridge that is detachably mountable to an electrophotographic image forming apparatus main body, comprising:

an electrophotographic photosensitive member;

a developing sleeve configured and positioned to develop an electrostatic latent image formed on said electrophotographic photosensitive member;

a first electrode;

a second electrode opposed to said first electrode; and an electrical contact portion configured and positioned to receive a bias to be applied to said developing sleeve and said second electrode from the electrophotographic image forming apparatus main body, wherein said first electrode and said second electrode are arranged in positions to which a developer can be admitted therebetween so that a value corresponding to a capacitance between said first electrode and said second electrode which exists at the time of applying a voltage to said second electrode is detectable by the electrophotographic image forming apparatus main body, thereby permitting the electrophotographic image forming apparatus main body to detect the amount of developer in said process cartridge.

9. A process cartridge according to claim 8, wherein the value corresponding to the capacitance between said first electrode and said second electrode and a value corresponding to the capacitance between said first electrode and said developing sleeve which exists at the time of applying the bias to said developing sleeve are detectable by the electrophotographic image forming apparatus main body, thereby permitting the electrophotographic image forming apparatus to detect the developer amount in said process cartridge.

10. A process cartridge according to claim 8 or 9, further comprising a laying electrode that is electrically connected to said second electrode, wherein said electrical contact portion is electrically connected to said laying electrode.

11. A process cartridge according to claim 10, wherein said electrical contact portion is arranged in a bottom surface of said process cartridge.

12. A process cartridge according to claim 8 or 9, further comprising a third electrode configured and positioned to detect the developer amount in said process cartridge, wherein said third electrode is electrically connected to said first electrode to have the same electrical potential as said first electrode.

13. A process cartridge according to claim 8 or 9, wherein said electrical contact portion is integrally provided with a transmitting-to-developing-sleeve portion configured and positioned to transmit the bias, which is received by said electrical contact portion from the electrophotographic image forming apparatus main body, to said developing sleeve, and a transmitting-to-second-electrode portion configured and positioned to transmit the bias to said second electrode.

14. A process cartridge according to claim 13, wherein said electrical contact portion, said transmitting-to-developing-sleeve portion, and said transmitting-to-second-electrode portion are integrally arranged in the stated order.

15. An electrophotographic image forming apparatus to which a process cartridge is detachably mountable and which is used for forming an image on a recording medium, comprising:

(i) a mounting portion configured and positioned to mount and detach the process cartridge, the process cartridge comprising an electrophotographic photosensitive member, a developing sleeve configured and positioned to develop an electrostatic latent image formed on the electrophotographic photosensitive member, a first electrode, a second electrode opposed to the first electrode, and an electrical contact portion configured and positioned to receive a bias to be applied to the developing sleeve and the second electrode from an electrophotographic image forming apparatus main body, wherein the first electrode and the second electrode are arranged in positions to which a developer can be admitted therebetween so that a value corresponding to a capacitance between the first electrode and the second electrode which exists at the time of applying a voltage to the second electrode is detectable by the electrophotographic image forming apparatus main body, thereby permitting the electrophotographic image forming apparatus main body to detect the amount of developer in the process cartridge;

(ii) detecting means, in the electrophotographic image forming apparatus main body, for detecting the developer amount in the process cartridge based on the value corresponding to the capacitance; and (iii) an image forming device configured and positioned to form an image on the recording material when said mounting portion mounts the process cartridge.

16. An electrophotographic image forming apparatus according to claim 15, wherein said detecting means detects the value corresponding to the capacitance between the first electrode and the second electrode and a value corresponding to a capacitance between the first electrode and the developing sleeve which exists at the time of applying the bias to the developing sleeve, thereby detecting the developer amount in the process cartridge.

17. An electrophotographic image forming apparatus according to claim 15 or 16, wherein the process cartridge includes a laying electrode that is electrically connected to the second electrode, and the electrical contact portion is electrically connected to the laying electrode.

18. An electrophotographic image forming apparatus according to claim 17, wherein the electrical contact portion is arranged in a bottom surface of the process cartridge.

19. An electrophotographic image forming apparatus according to claim 15 or 16, wherein:

the process cartridge includes a third electrode configured and positioned to detect the developer amount in the process cartridge; and the third electrode is electrically connected to the first electrode to have the same electrical potential as the first electrode.

20. An electrophotographic image forming apparatus according to claim 15 or 16, wherein the electrical contact portion is integrally provided with a transmitting-to-developing-sleeve portion configured and positioned to transmit the bias, which is received by the electrical contact portion from the electrophotographic image forming apparatus main body, to the developing sleeve, and a transmitting-to-second-electrode portion configured and positioned to transmit the bias to the second electrode.

21. An electrophotographic image forming apparatus according to claim 20, wherein the electrical contact portion, the transmitting-to-developing-sleeve portion, and the transmitting-to-second-electrode portion are integrally arranged in the stated order.

* * * * *